United States Patent [19]

Bell

[11] 4,160,331

[45] Jul. 10, 1979

[54] OUTER SHOE WITH GRIPPING SURFACE

[76] Inventor: Michael Bell, P.O. Box 400, Warrington, Pa. 18976

[21] Appl. No.: 879,163

[22] Filed: Feb. 21, 1978

[51] Int. Cl.[2] ..... A43B 23/28

[52] U.S. Cl. ..... 36/59 B

[58] Field of Search ..... 36/59 R, 59 A, 59 B, 36/59 C, 32 R

[56] References Cited

U.S. PATENT DOCUMENTS

| | | | |
|---|---|---|---|
| 1,350,839 | 8/1920 | Rendle | 36/59 B |
| 1,796,399 | 3/1931 | Roodhouse | 36/59 B |
| 3,031,196 | 2/1936 | Vicente | 36/59 B |

*Primary Examiner*—Patrick D. Lawson

*Attorney, Agent, or Firm*—Caesar, Rivise, Bernstein & Cohen, Ltd.

[57] ABSTRACT

A shoe having a slip resistant or gripping surface on the sole thereof. Preferably, the shoe is an outer shoe, such as a rubber or boot. The gripping surface is applied to the sole in separated, discrete bands within channels in the sole and comprises a mixture of a grit, such as silicon carbide, and an adhesive. The gripping surface is used to prevent or curtail slipping by the wearer on smooth surfaces, such as ice or snow.

10 Claims, 3 Drawing Figures

FIG. 1
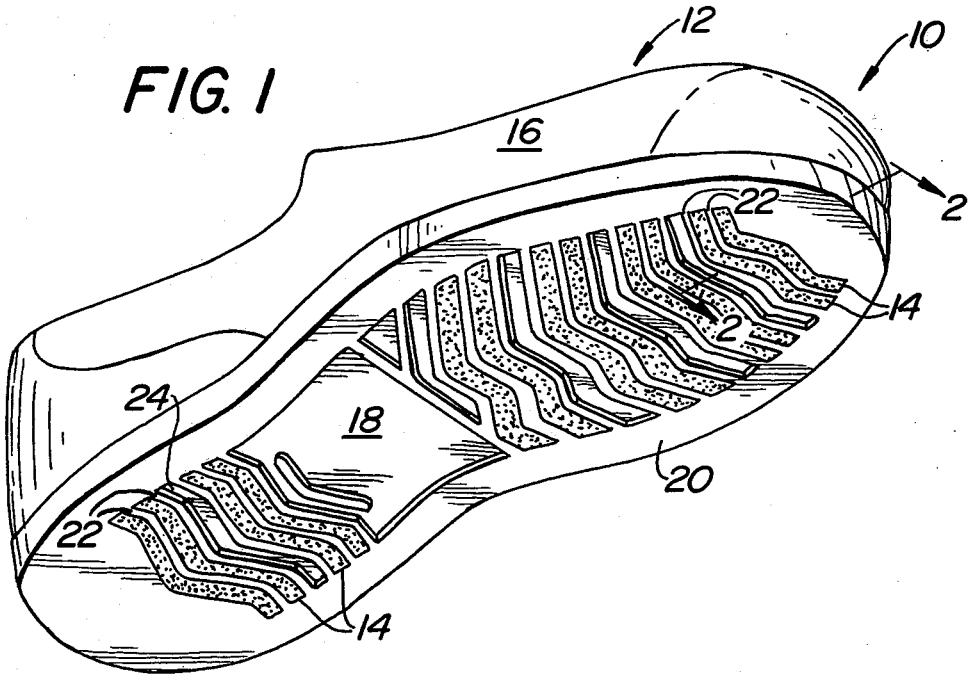
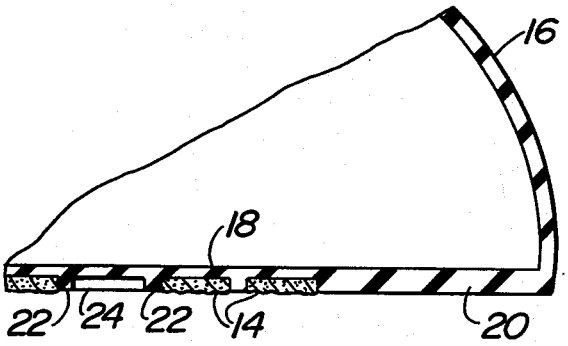
FIG. 2
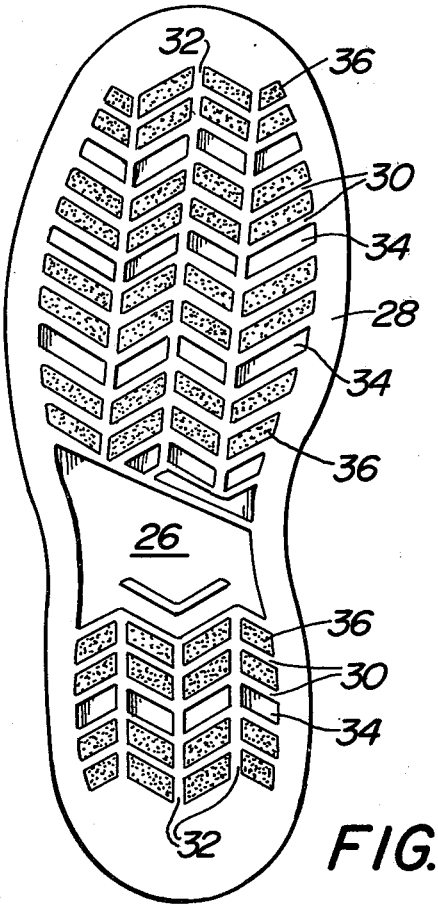
FIG. 3

OUTER SHOE WITH GRIPPING SURFACE

This invention relates to a shoe, and more particularly, to an outer shoe having a gripping surface on the outer surface of the sole thereof.

Walking on ice, even when wearing overshoes, is extremely treacherous. Thus, even where the overshoes are provided with flexible rubber gripping ridges, it is still quite easy to slip on the ice, with the possible result of broken bones. Various devices have been designed in the past to prevent slippage on ice. These devices comprise metal gripping teeth which are secured on a shoe or overshoe by a strap that passes around the shoe or overshoe and is fastened over the shoe or overshoe. These devices are effective in preventing or curtailing slippage, but they have a number of disadvantages. They are uncomfortable to wear and can do substantial damage to ordinary flooring, such as wood, vinyl tile, asphalt, etc. Additionally, because they are strap-on devices, they may not always be available for use since they may be stored away. Further, because a fair amount of time is needed to apply these devices, they are not always used. They are normally only used over the sole portion of the shoe, and there is no slippage-preventor available for the heel.

All of these problems of the prior art strap-on devices are obviated by the instant invention. The invention forms an integral part of the shoe or overshoe, and need not be applied separately from the shoe or overshoe. The non-slip surface of this invention is applied at both the heel and sole area of the shoe, thereby giving greater slippage prevention.

Prior to the instant invention, another attempt was made to render an outer shoe slip-resistant. To accomplish this, the prior outer shoe, which was a flexible rubber, was provided with a slip-resistant surface that formed an integral part of the rubber. Thus, the sole of the rubber was provided with strips comprising an adhesive and a grit material secured within the adhesive. The strips were applied to the flat outer surface of the bottom of the rubber.

Although, in theory, this prior outer shoe would effectively prevent slippage, it was found that there were a number of problems with the outer shoe which rendered it commercially non-feasible. More particularly, it was found that during normal wearing, the strips were quickly abraded away whenever the user of the rubbers was walking on solid surfaces, such as concrete. Quite often, these strips would be totally worn off the surface of the rubber within a period of a few days. To the best of applicant's knowledge, this prior rubber was a complete commercial failure, and is no longer available.

The instant invention is, in part, based on the prior rubber which proved to be non-effective. Thus, it was realized by the applicant herein that the composition comprising an adhesive and the grit could effectively prevent slipping. The problem that had to be overcome was how to make the adhesive and grit composition sufficiently durable to last throughout the normal life of the rubber or other shoe on which it is applied.

After recognizing the existence of the problem, the instant invention was created as a solution to the problem. More particularly, it was determined that if the adhesive and grit composition were placed within channels in the sole of the rubber or other shoe, and if there were walls around the adhesive and grit composition, the composition would be maintained in place on the bottom of the rubber or shoe, and in addition, would not wear any more quickly than the walls surrounding the composition. However, the composition would still have the full slip-resistant properties of the prior strips which were placed on the flat bottom of the rubber.

Furthermore, the walls of the channels hold the composition securely on the bottom of the rubber or shoe, and prevent the composition from inadvertently being knocked off. In the prior rubbers, because the strips were merely secured on the flat bottom of the rubber, quite often they would be knocked off during use, in addition to being worn out rapidly.

It is therefore an object of this invention to provide a shoe having a gripping surface thereon.

It is another object of this invention to provide a shoe or outer shoe having a gripping surface forming a part thereof, which surface is provided in the heel and sole area.

These and other objects of this invention are accomplished by providing a shoe having a gripping surface on the outer side of the bottom thereof, said gripping surface comprising an adhesive and a grit, said adhesive and grit being positioned in discrete channels on said outer side of the shoe.

Other objects and many of the attendant advantages of this invention will be readily appreciated as the same becomes better understood by reference to the following detailed description when considered in connection with the accompanying drawings wherein:

FIG. 1 is a perspective view of an outer shoe embodying the present invention;

FIG. 2 is an enlarged sectional view taken along the line 2—2 of FIG. 1; and

FIG. 3 is a bottom plan view of a modified embodiment of the outer shoe of FIG. 1.

Referring now in greater detail to the various figures of the drawings wherein like reference characters refer to like parts, an outer shoe with gripping surface embodying the present invention is generally shown at 10 in FIG. 1. Device 10 basically comprises a conventional flexible rubber outer shoe 12 having a plurality of gripping segments 14 on the bottom thereof.

The outer shoe 12 can be of any conventional design. As shown in FIG. 1, the outer shoe 12 has the same height as a conventional shoe over which it will be placed, and is generally referred to as a rubber. Outer shoe 12 is molded in a manner well known to the art, and can be formed from any flexible, water-proof material such as rubber, neoprene or polyvinyl chloride. The shoe 12 includes an upper portion 16 and a bottom or sole portion 18. The sole portion 18 includes a thickened rib 20 which extends around the bottom perimeter thereof. The rib 20 is to aid in the durability of the outer shoe 12. A plurality of transverse ribs 22 extend across the sole portion 18. The transverse ribs 22 leave channels 24 therebetween. The purpose of the transverse ribs 22 is to add to the slip resistence of the outer shoe 12.

To the extent described, the structure of the outer shoe 12 is exemplary of the outer shoes now being sold. Thus, substantially all of these outer shoes are formed from a flexible, rubber or rubber-like material, and include the transverse ribs. In any given brand of outer shoe, the rib pattern may vary. However, the function of the rib is the same in all of the outer shoes. The novel feature of this invention relates to the provision of a gripping material which is placed in some, but not all, of the channels 24 between the ribs. As seen in FIGS. 1 and 2, the gripping segments 14 fill two adjacent channels, with the next adjacent channel being unfilled. The gripping segments 14 are formed from a composition comprising an adhesive binder and a rough, grit-like material. The composition is applied to the channels and the binder is permitted to harden. As seen in FIG. 2, the gripping segments 14 project below the lower surface of the sole portion of the overshoe, and thus will contact the ice or other material which is being walked on. The contact of the grit with ice prevents the wearer of the outer shoe from slipping on the ice, since the grit will penetrate the ice and prevent slipping.

In the embodiment of the invention shown in FIGS. 1 and 2, the gripping segments 14, which are rigid, are separated in discrete areas from other gripping segments through the use of the unfilled channels 24. Having the unfilled channels gives longitudinal flexibility to the outer shoe when it is being worn. In the embodiment of the invention shown in FIG. 3, both longitudinal and lateral flexibility are provided. Thus, the sole portion 26 of the outer shoe of FIG. 3 is shown. The upper portion is identical to that shown in FIG. 1. In the embodiment of FIG. 3, a rib 28 is again provided around the perimeter of the sole portion. Lateral rubber ribs 30 project across the width of the sole portion. Additionally, vertically extending ribs 32 join all of the lateral ribs 30, thereby forming discrete cavities 34. Some, but not all, of the discrete cavities 34 are filled with the gripping composition of this invention, as shown at 36. The gripping composition projects below the ribs 28, 30 and 32, in the same manner as shown in FIG. 2 with respect to gripping segments 14.

The embodiment of the invention shown in FIG. 3 differs from that shown in FIGS. 1 and 2 to the extent that the FIG. 3 embodiment has both lateral and longitudinal flexibility. Thus, the longitudinal flexibility is provided by the unfilled cavities 34, which project across the width of the outer shoe. The lateral flexibility is provided by the aligned vertically extending ribs 32. Again, it should be kept in mind that the gripping composition is rigid, and has no inherent flexibility.

The gripping composition used for segments 14 and 36 comprises any suitable combination of an adhesive that is compatible with the flexible outer shoe 12 and a grit material. A preferred adhesive is an epoxy adhesive and a preferred grit is silicon carbide, because of its durability. However, any adhesive known to the art can be used, such as a silicone adhesive, a urethane adhesive or a polyester adhesive. Other grits that can be used are coarse sand or crushed rock.

The gripping composition is applied by placing the adhesive, which is in a paste-like consistency, into a conventional caulking gun. The adhesive is then extruded into the channels 24 or cavities 34. With the adhesive in place, the shoe is then pressed into a container holding the grit, whereby the grit will be impregnated into the adhesive and be present on the surface of the adhesive. The adhesive is then permitted to dry, and the shoe will then be ready for use. When an epoxy adhesive is used, it will air dry in about five days. The application of heat can expedite the drying time.

The foregoing method of applying the gripping composition is the preferred method. However, as an alternative method, the composition can be applied by first mixing the adhesive and grit, and placing the mixture in a caulking gun. Thereafter, the mixed composition is extruded into the channels 24 or cavities 34, which are to be filled with the composition. Again, the adhesive is then permitted to dry, at which point the shoe is ready for use.

The ratio of adhesive to grit can vary with the specific adhesive and grit being used. There must be sufficient adhesive to securely bond the grit in place. However, there should not be so much adhesive that it would completely encapsulate all of the grit, thereby removing the gripping properties of the grit. A preferred ratio is 75% by weight of adhesive and 25% by weight of grit. However, these ratios can be varied within the parameters set forth above.

Although this invention is particularly useful in connection with outer shoes, such as rubbers, boots, etc., it can also be used on all types of footwear. Another use of the invention would be as a coating on the soles and heels of climbing boots or sport shoes. The invention can also be used on industrial shoes and boots to prevent slipping on oil, grease or water.

As seen in FIGS. 1 and 3, the gripping composition is applied in discrete channels across the entire bottom of the shoe. It is present in both the sole and heel area of the bottom. However, because of the uncoated or unfilled areas of the bottom, there is still flexibility in the shoe, which will permit normal walking movement. When the strap-on metal plates are used, there is no flexibility in these plates, and accordingly it is much more difficult to walk when utilizing these plates to prevent slipping.

Insofar as the prior art rubbers having the gripping strips are concerned, the instant invention provides a distinct advantage thereover. As previously explained, the unprotected strips readily wore out during use, and in many cases, could be knocked off the sole of the rubber. Contrasted with this, as best seen in FIG. 2, utilizing the instant invention, the gripping composition 14 or 36 is totally confined within channels on the bottom of the shoe. Thus, all of the edges of the gripping segments are protected by rubber ribs, such as ribs 20 and 22 in connection with the embodiments of FIGS. 1 and 2, and rubber ribs 28, 30 and 32 in connection with the embodiment of FIG. 3. The rubber ribs serve the dual function of protecting the gripping segments against wear and preventing the gripping segments from being knocked off the bottom of the shoe.

Although the portion of the gripping segments projecting below the rubber ribs, as seen in FIG. 2, may initially be worn down, once the bottom of the gripping segments are co-planar with the rubber ribs, it has been found that they will not wear any more quickly than the rubber ribs. However, because the rubber ribs are compressable during wear, the gripping segments will contact the surface being walked on, and will accordingly provide the slip-resistant qualities to the shoe.

Without further elaboration, the foregoing will so fully illustrate my invention, that others may, by applying current or future knowledge, readily adapt the same for use under various conditions of service.

What is claimed as the invention is:

1. A shoe having a bottom surface formed from a flexible, water-proof material, said material being selected from the group consisting of natural rubber, synthetic rubber and polyvinyl chloride, said bottom surface having a plurality of discrete channels formed therein, and a gripping material in some, but not all, of said channels, said gripping material comprising an adhesive and a grit, whereby there are discrete areas of said gripping material in said bottom surface.

2. The shoe of claim 1 wherein said adhesive and grit project below the outer edges of said channels.

3. The shoe of claim 1 wherein said shoe comprises an outer shoe.

4. The shoe of claim 1 wherein said discrete areas of adhesive and grit are separated by flexible areas extending across the width of the bottom of said shoe.

5. The shoe of claim 4 wherein said adhesive and grit areas are additionally separated by flexible areas which extend along the length of the bottom of said shoe.

6. The shoe of claim 1 wherein said adhesive comprises an epoxy adhesive.

7. The shoe of claim 1 wherein said grit comprises silicon carbide.

8. The shoe of claim 1 wherein said gripping surface is formed from a composition comprising approximately 75% adhesive by weight and 25% grit by weight.

9. The shoe of claim 1 wherein the gripping surface includes an amount of adhesive which is sufficient to bond the grit in place, but which amount is not so great that it would completely encapsulate the grit.

10. The shoe of claim 1 wherein said channels are formed by dependent walls, and said adhesive and grit are laterally confined within said walls.

* * * * *